US007213810B2

(12) United States Patent
Marshall

(10) Patent No.: US 7,213,810 B2
(45) Date of Patent: May 8, 2007

(54) SYSTEM AND METHOD FOR CHARTING NUMBERS GAMES

(76) Inventor: Randall S. Marshall, 5225 Ames St. NE., Washington, DC (US) 20019-6606

( * ) Notice: Subject to any disclaimer, the term of this patent is extended or adjusted under 35 U.S.C. 154(b) by 140 days.

(21) Appl. No.: 10/725,334

(22) Filed: Dec. 2, 2003

(65) Prior Publication Data

US 2004/0145115 A1 Jul. 29, 2004

Related U.S. Application Data

(63) Continuation-in-part of application No. 09/422,107, filed on Oct. 20, 1999, now abandoned.

(51) Int. Cl.
*A63F 3/06* (2006.01)

(52) U.S. Cl. ..... 273/139; 283/903

(58) Field of Classification Search ..... 273/138.1, 273/139, 148 R; 283/903
See application file for complete search history.

(56) References Cited

U.S. PATENT DOCUMENTS 591,319 A 10/1897 Baker
1,406,941 A 2/1922 Davenport
4,688,797 A 8/1987 Sebestyen
5,110,129 A * 5/1992 Alvarez ..... 463/18
5,249,801 A 10/1993 Jarvis
5,273,281 A 12/1993 Lovell
5,494,293 A 2/1996 Goldfarb
5,518,239 A 5/1996 Johnson
5,782,470 A 7/1998 Langan

OTHER PUBLICATIONS

The Big Game Mega Millions from the Virginia Lottery, May 2002.*
"Doctor Gray's Grid", Ohio 3-Digit History & Scoreboard, Guntis Apse, Copyright 1988.
Scarne's Complete Guide to Gambling, "Roulette System: System Players", pp. 369-371, Simon and Schuster, 1961.

* cited by examiner

*Primary Examiner*—William M. Pierce
(74) *Attorney, Agent, or Firm*—Cahn & Samuels, LLP

(57) ABSTRACT

A play slip chart for a lottery game, for example, includes at least one board having a plurality of numbers. The numbers are divided into a plurality of groups of numbers called positions and further divided into a plurality zones. Each zone is defined by one or more landmark lines. The play slip chart further includes a game number recording section and a correct digit recording section.

8 Claims, 7 Drawing Sheets

SYSTEM AND METHOD FOR CHARTING NUMBERS GAMES

This is a continuation-in-part of application Ser. No. 09/422,107 filed Oct. 20, 1999 now abandoned.

I. FIELD OF THE INVENTION

The present invention relates to the field of number games of chance such as lotteries, keno, bingo, etc. More particular, it relates to a play slip and matching play slip chart having zones marked with one or more landmark lines used for charting, locating, selecting, evaluating, managing, and monitoring numbers over a specific number of games up to a time of selecting numbers for placing a bet for such games.

II. DESCRIPTION OF THE PRIOR ART

In number games, such as lottery, keno, bingo, and the like, a player is required to guess a designated quantity of randomly generated numbers from those shown on a play slip. Some games also require guessing numbers in the sequence in which they are generated. Numbers are sometimes drawn in some kind of order or patterns that can be recognized and understood by experienced players through charting, monitoring, and evaluating activity and inactivity on a short to long term basis. However, charting to monitor randomly generated numbers is seldom done with the use of conventional charting systems, which gives information about drawn numbers but requires a great deal of a player's time. The existing play slip has one use in today's lottery; it is used to place at least one bet and is typically discarded as useless. With some improvements to be made, the existing play slip can be modified and used for charting, locating, monitoring, evaluating, managing, and selecting numbers, which will help a player. However, using an existing play slip as a chart without adding a chart-like structure and organization would be ineffective. Existing lottery play slips are divided into a series of boards containing a plurality of numbers for a player's selection for placing a bet. Each board of a play slip has numbers in positions from one to approximately 10, 20, 30, 40, 50, 60, 70, 100, and more. A player selects one or more numbers from each board by placing a mark on each number. Players often make mistakes when marking numbers to place a bet for at least one of the following reasons: The player has to look for numbers that are difficult to find because there are so many on a board; many players don't use some play slips because they are too complicated, even though designed to save time when placing a bet; the numbers are small and difficult to manage; and, a player with impaired vision often has trouble locating and seeing the numbers. Consequently, when winning numbers are drawn over a specific number of games, a player has no "visual play slip picture" of how the previous performance of numbers relate to areas of a play slip up to a time of selecting numbers for placing a bet.

Another situation that exist is a small sample board with instructions is sometimes found on the backside of a play slip. The numbers of the sample play slip board are more difficult to see than those on the play slip; therefore, the use of interior reference lines on the sample board matching those on a play slip are needed to help prospective players to relate and better understand the instructions for using the play slip.

III. SUMMARY OF THE PRESENT INVENTION

One of the objects of the present invention is to provide a betting system comprising a play slip and play slip chart having at least one board containing a plurality of numbers being divided into a plurality of groups of numbers called positions. The positions are further divided into a plurality of groups of numbers called zones. The zones are marked with one or more landmark lines for charting, locating, selecting, evaluating, managing, and monitoring numbers drawn from a plurality of numbers over a specific number of games up to a time of selecting numbers for placing a bet.

Another object of the present invention is to provide a betting system comprising a play slip and play slip chart, similar to an existing play slip, having at least one board containing a plurality of numbers being divided into a plurality of groups of numbers called positions. The positions are further divided into a plurality of groups of numbers called zones. The zones are marked with one or more landmark lines for charting, locating, selecting, evaluating, managing, and monitoring numbers drawn from a plurality of numbers over a specific number of games up to a time of selecting numbers for placing a bet.

Another object of the present invention is to provide a betting system comprising a play slip having at least one board containing a plurality of numbers being divided into a plurality of groups of numbers called positions. The positions are further divided into a plurality of groups of numbers called zones. At least one board is marked with the use of one or more landmark lines to define active and inactive zones of a play slip for numbers drawn over a specific number of games up to a time of selecting numbers for placing a bet. The play slip with zones is used to chart, locate, evaluate, select, manage, and monitor numbers drawn over a specific number of games; wherein, a player with impaired or diminishing vision can better locate numbers on a board and better see a particular number's activity and inactivity on a particular day for a specific number of previous games, as related to numbers on a play slips up to a time of selecting numbers for placing a bet.

Another object of the present invention is to provide a betting system comprising a play slip having at least one board containing a plurality of numbers being divided into a plurality of groups of numbers called positions. The positions are further divided into a plurality of groups of numbers called zones. At least one board is marked with the use of one or more fixed landmark lines to emphasize at least one boundary of active and inactive zones of a play slip for numbers drawn over a specific number of games up to a time of selecting numbers for placing a bet. The play slip with zones is used to chart, locate, evaluate, select, manage, and monitor winning numbers drawn over a specific number of games; wherein, a player with impaired or diminishing vision can better locate numbers on a board and better see a particular number's activity and inactivity on a particular day for a specific number of previous games, as related to numbers on a play slip up to a time of selecting numbers for placing a bet.

Another object of the present invention is to provide a betting system comprising, in combination, a play slip and matching play slip chart. The play slip has at least one board containing a plurality of numbers being divided into a plurality of groups of numbers called positions: The positions are further divided into a plurality of groups of numbers called zones. At least one board is marked with the use of one or more landmark lines to define active and inactive zones of the play slip for numbers drawn over a specific number of previous games, as related to numbers on the play slip up to a time of selecting numbers for placing a bet. The play slip with zones is used to chart, locate, evaluate, select, manage, and monitor numbers drawn over a specific number of previous games; wherein, a player with impaired or diminishing vision can better locate numbers on a board and better see a particular number's activity and inactivity on a particular day for a specific number of previous games, as related to numbers on the play slip up to a time of selecting numbers for placing a bet; and, a matching play slip chart having at least one board containing a plurality of numbers is divided into a plurality of groups of numbers called positions: The positions are further divided into a plurality of numbers called zones. At least one board is marked with the use of one or more landmark lines to define active and, inactive zones for numbers drawn over a specific number of previous games, as related to numbers on the play slip up to a time of selecting numbers for placing a bet. Consequently, a play slip chart with zones is used to chart, locate, evaluate, select, manage, and monitor winning numbers drawn, as related to a matching play slip; wherein, a player with impaired or diminishing vision can better locate numbers on a board and better see a particular number's activity and inactivity on a particular day for a specific number of previous games, as related to numbers on a play slip and matching play slip chart up to a time of selecting numbers for placing a bet.

Another object of the present invention is to provide a betting system comprising, in combination, a play slip and matching play slip chart. The play slip has at least one board containing a plurality of numbers being divided into a plurality of groups of numbers called positions: The positions are further divided into a plurality of groups of numbers called zones. At least one board is marked with the use of one or more fixed landmark lines to define active and inactive zones of the play slip for numbers drawn over a specific number of previous games, as related to numbers on the play slip up to a time of selecting numbers for placing a bet. The play slip with zones is used to chart, locate, evaluate, select, manage, and monitor numbers drawn over a specific number of previous games; wherein, a player with impaired or diminishing vision can better locate numbers on a board and better see a particular number's activity and inactivity on a particular day for a specific number of previous games, as related to numbers on the play slip up to a time of selecting numbers for placing a bet; and, a matching play slip chart having at least one board containing a plurality of numbers is divided into a plurality of groups of numbers called positions: The positions are further divided into a plurality of numbers called zones. At least one board is marked with the use of one or more fixed landmark lines to define active and inactive zones for numbers drawn over a specific number of previous games, as related to numbers on the play slip up to a time of selecting numbers for placing a bet. Consequently, a play slip chart with zones is used to chart, locate, evaluate, select, manage, and monitor winning numbers drawn, as related to a matching play slip; wherein, a player with impaired or diminishing vision can better locate numbers on a board and better see a particular number's activity and inactivity on a particular day for a specific number of previous games, as related to numbers on a play slip and matching play slip chart up to a time of selecting numbers for placing a bet.

Another object of the present invention is to provide a method for charting numbers game results to facilitate a user in making predictions about future results.

Other objects and advantages over the prior art will become apparent to those skilled in the art upon reading the detailed descriptions together with the drawings described as follows.

IV. BRIEF DESCRIPTION OF THE DRAWINGS

The following examples are intended for illustration only and are not intended to limit the present invention in any combination of related ways shown.

V. DETAILED DESCRIPTION OF THE INVENTION

Figure 1:
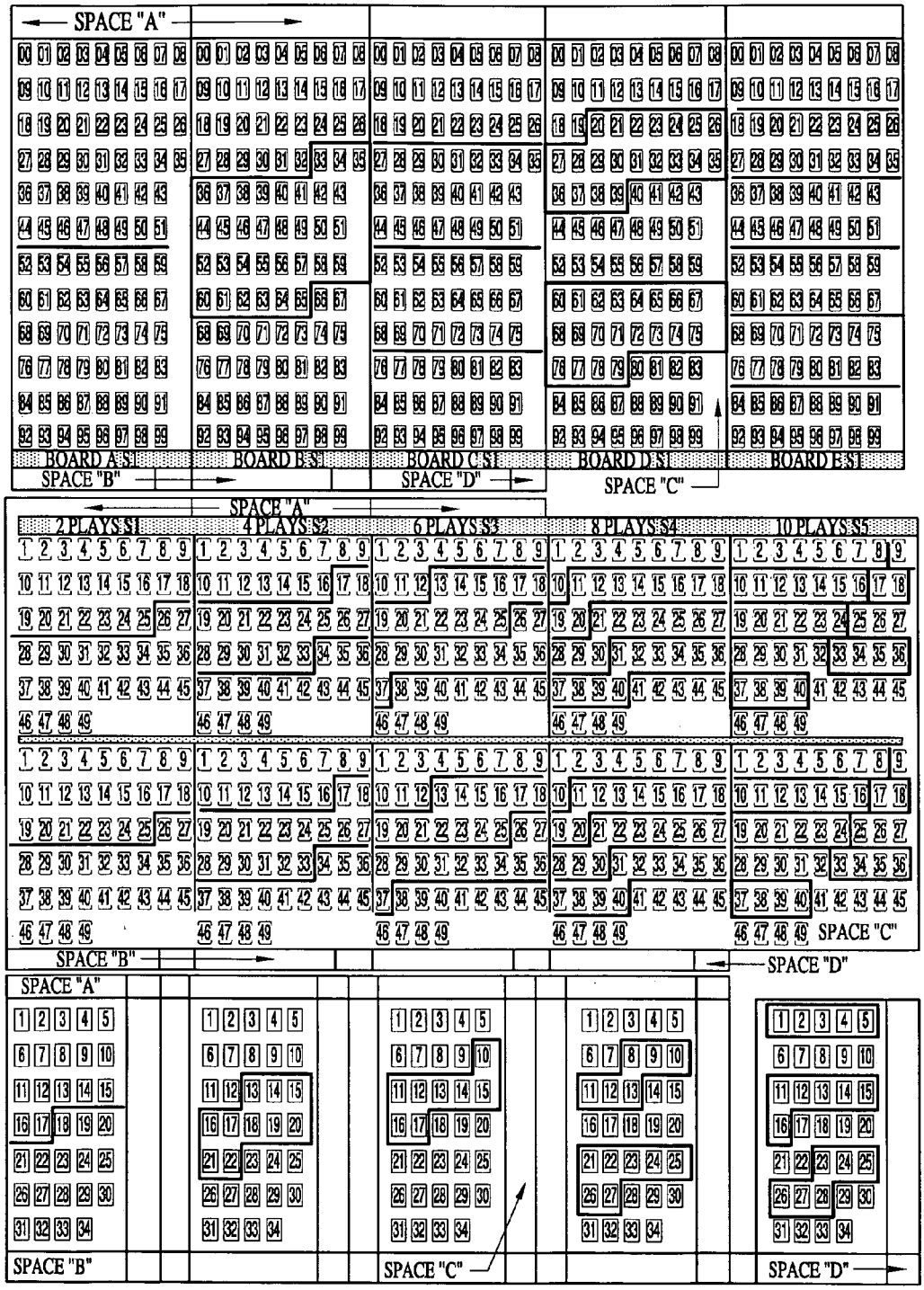
FIG. 1 illustrates a play slip in accordance with the invention.

FIG. 1 shows a play slip and play slip chart having up to 5 similar boards with dissimilar zones and landmark lines marked "A" through "E". In the first example, each board has 12 horizontal positions divided into various zones with the use of one or more landmark lines. At least one landmark line divides vertically, horizontally, or combined vertically and horizontally, as illustrated in boards "A" through "E". All zones with one or more landmark lines are used for charting, locating, monitoring, evaluating, selecting, managing, and monitoring numbers over a specific number of previous games, as related to numbers on a play slip and play slip chart up to a time of selecting numbers for placing a bet, as follows: board "A" is divided into 2 zones with the use of one landmark line; board "B" is divided into 3 zones with the use of 2 combined horizontal and vertical landmark lines; board "C" is divided into 4 zones with the use of 3 landmark lines; board "D" is divided into 5 zones with the use of 4 combined horizontal and vertical landmark lines; and, board "E" is divided into 6 zones with the use of 5 landmark lines. As a play slip, at least one board is used for placing a bet. As a chart, the top or space "A" is used for game date and interval number of a module based on a specific number of previous games; space "B" is used for placing numbers as drawn; space "C" is used for placing notes by the player; and, space "D" is used for placing the number of correct numbers (digits) selected by the player. The other two examples show how play slips and play slip charts may have boards of various number sizes and shapes, up to ten zones and landmark lines, and mixed boards with different zones.

Figure 2:
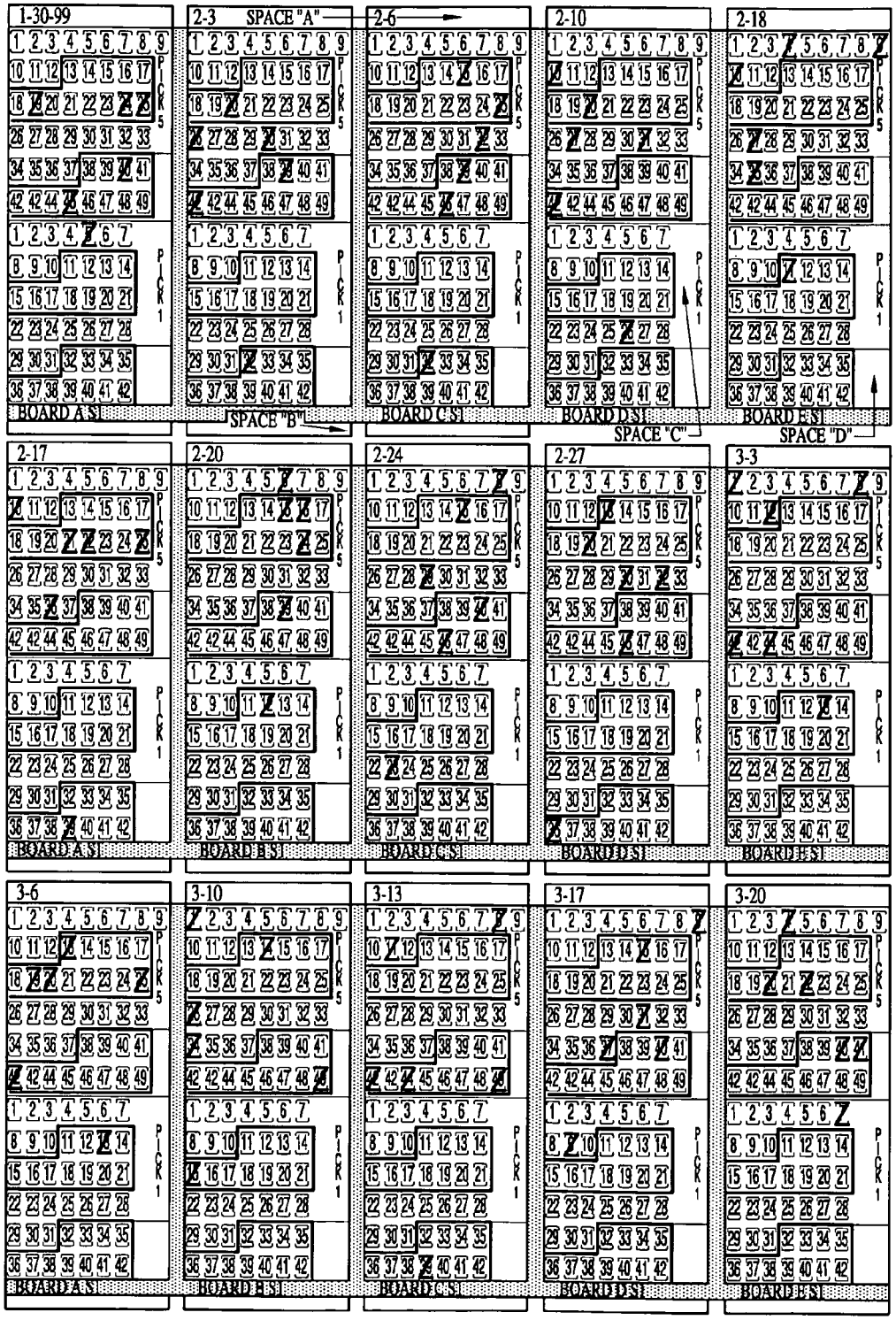
FIG. 2 depicts a completed play slip in accordance with the invention.

FIG. 2 shows a partially executed play slip and play slip chart of a large national lottery game having up to 5 similar boards with similar zones and landmark lines, "A" through "E". All zones with landmark lines are used for charting, locating, monitoring, evaluating, managing, and selecting numbers for placing a bet. As a play slip, at least one board is used for placing a bet. As a chart, the top or space "A" is used for game date and interval number of a module based on a specific number of previous games; space "B" is used for placing numbers as drawn; space "C" is used for placing notes by the player; and, space "D" is used for placing the number of correct numbers (digits) selected by the player. Each board is dated and divided into upper and lower portions with 6 horizontal positions in each. Each of the 6 positions is divided into 4 zones with combined vertical and horizontal landmark lines. Randomly drawn numbers are marked on each board indicating active and inactive zones, numbers drawn as companions, frequently drawn numbers, skips between frequently drawn numbers, and other patterns over a specific number of previous games, as related to numbers on a matching play slip and play slip chart up to a time of selecting numbers for placing a bet. In this example, boards dated 2-3, and 2-6-99 show a consecutive number (39) drawn in the fourth zone of the upper portion and selected again on 2-2099 after skipping 3 games; boards dated 1-30, 2-24, 3-17, and 3-20-99 show a frequently drawn number (40) in an active fourth zone of the upper portion; boards dated 2-6, 2-20, 2-24, and 3-17-99 show a frequently drawn number (15) in the second zone of the upper portion; boards dated 2-27 and 3-6-99 show companion numbers (13 and 20) drawn in the second zone of the upper portion; and, boards dated 2-6 and 2-24, and 2-27-99 show a frequently drawn number (46) in the fourth zone of the upper portion with companions (13 or 15) of the second zone. The following examples show how a play slip and play slip chart may have similar boards in various sizes and shapes with up to ten zones and landmark lines in various board zones. Each of the following play slips and play slip charts has similar boards and zones with landmark lines used for charting, locating, monitoring, evaluating, managing, and selecting numbers over a specific number of games up to a time of selecting numbers for placing a bet.

Figure 3:
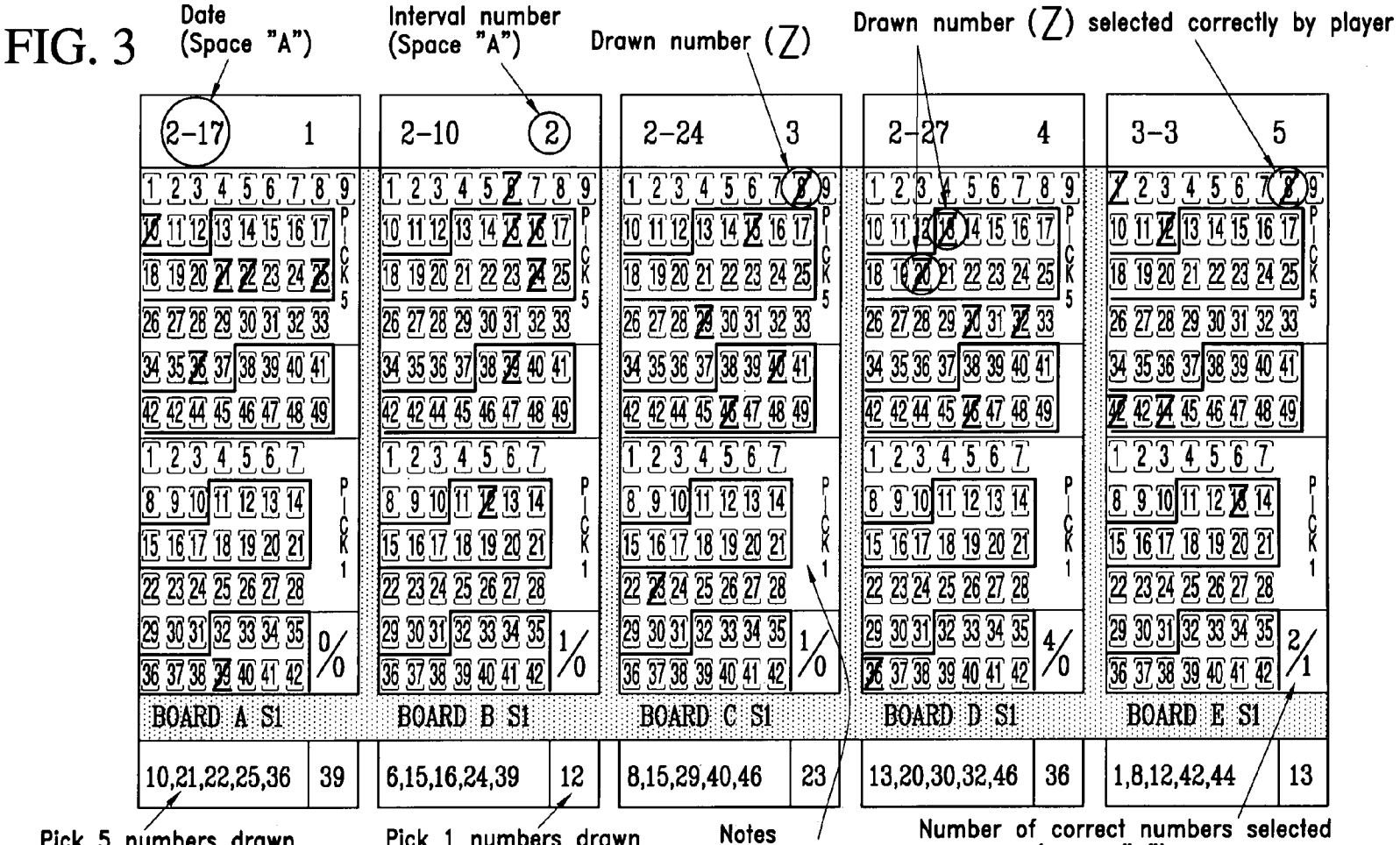
FIG. 3 shows an enlarged view of a portion of center play slip of FIG. 2.

FIG. 3 shows the middle play slip of FIG. 2 enlarged. The enlargement illustrates typical areas of a play slip and play slip chart used for recording information, as related to numbers drawn. As a play slip, at least one board is used for placing a bet. As a chart, the top or space "A" is used for game date and interval number of a module based on a specific number of previous games; space "B" is used for placing numbers as drawn; space "C" is used for placing notes by the player; and, space "D" is used for placing the number of correct numbers (digits) selected by the player.

Figure 4:
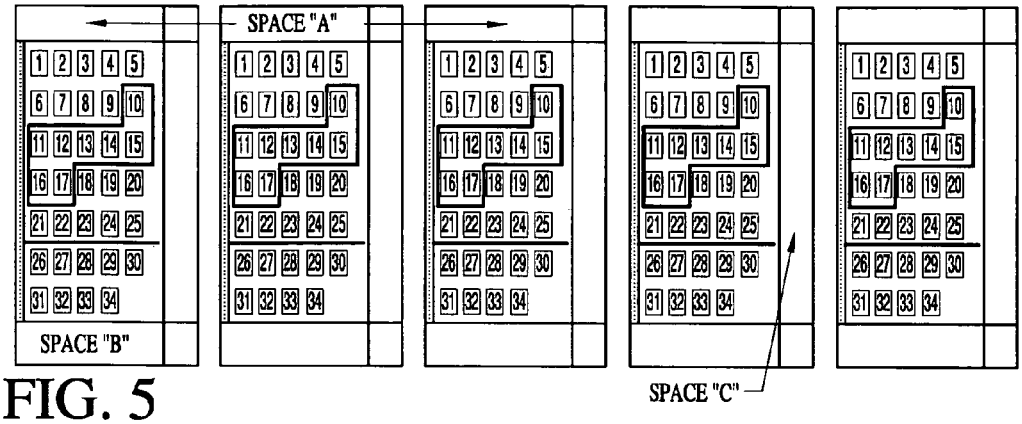
FIG. 4 illustrates alternate play slip containing multiple boards.

FIG. 4 shows a play slip and play slip chart containing multiple boards. Each board has horizontal numbering positions divided into 4 zones with 3 landmark lines. As a play slip, at least one board is used for placing a bet. As a chart, the top or space "A" is used for game date and interval number of a module based on a specific number of previous games; space "B" is used for placing numbers as drawn; space "C" is used for placing notes by the player; and, space "D" is used for placing the number of correct numbers (digits) selected by the player.

Figure 5:
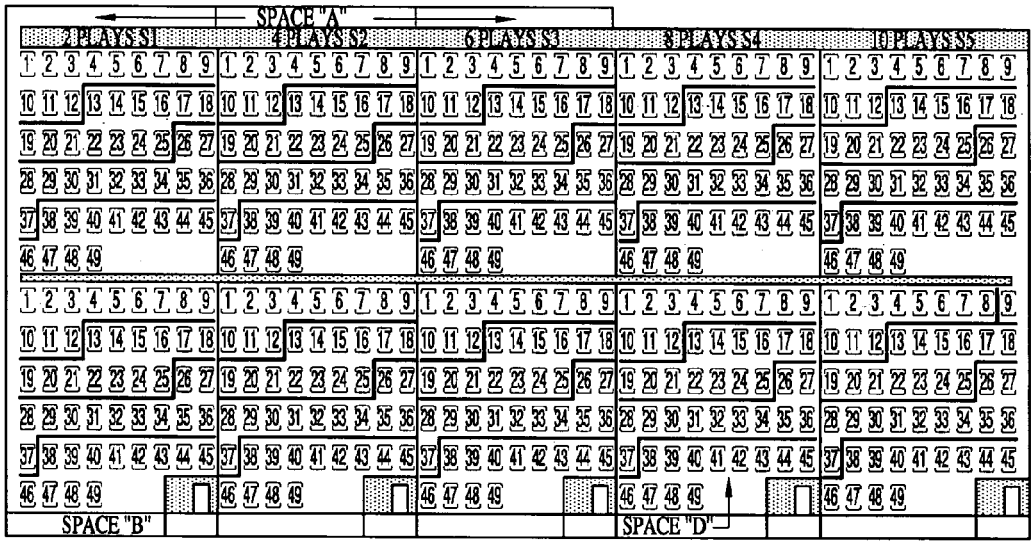
FIG. 5 shows still another embodiment of a play slip having multiple boards.

FIG. 5 shows a play slip and play slip chart containing multiple boards with an upper and lower portion. Both upper and lower portions have horizontal numbering positions divided into 4 zones with 3 landmark lines. As a play slip, at least one board is used for placing a bet. As a chart, the top or space "A" is used for game date and interval number of a module based on a specific number of previous games; space "B" is used for placing numbers as drawn; space "C" is used for placing notes by the player; and, space "D" is used for placing the number of correct numbers (digits) selected by the player.

Figure 6:
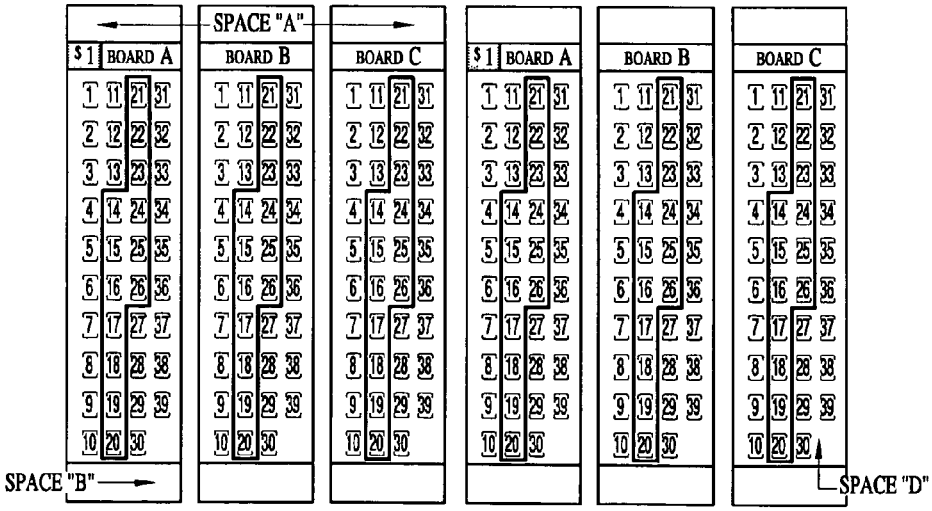
FIG. 6 illustrates yet another embodiment of a play slip having multiple boards.

FIG. 6 shows a play slip and play slip chart containing multiple boards similar to an existing play slip with vertical numbering positions divided into 3 zones with 2 landmark lines.

As a play slip, at least one board is used for placing a bet. As a chart, the top or space "A" is used for game date and interval number of a module based on a specific number of previous games; space "B" is used for placing numbers as drawn} space "C" is used for placing notes by the player; and, space "D" is used for placing the number of correct numbers (digits) selected by the player.

Figure 7:
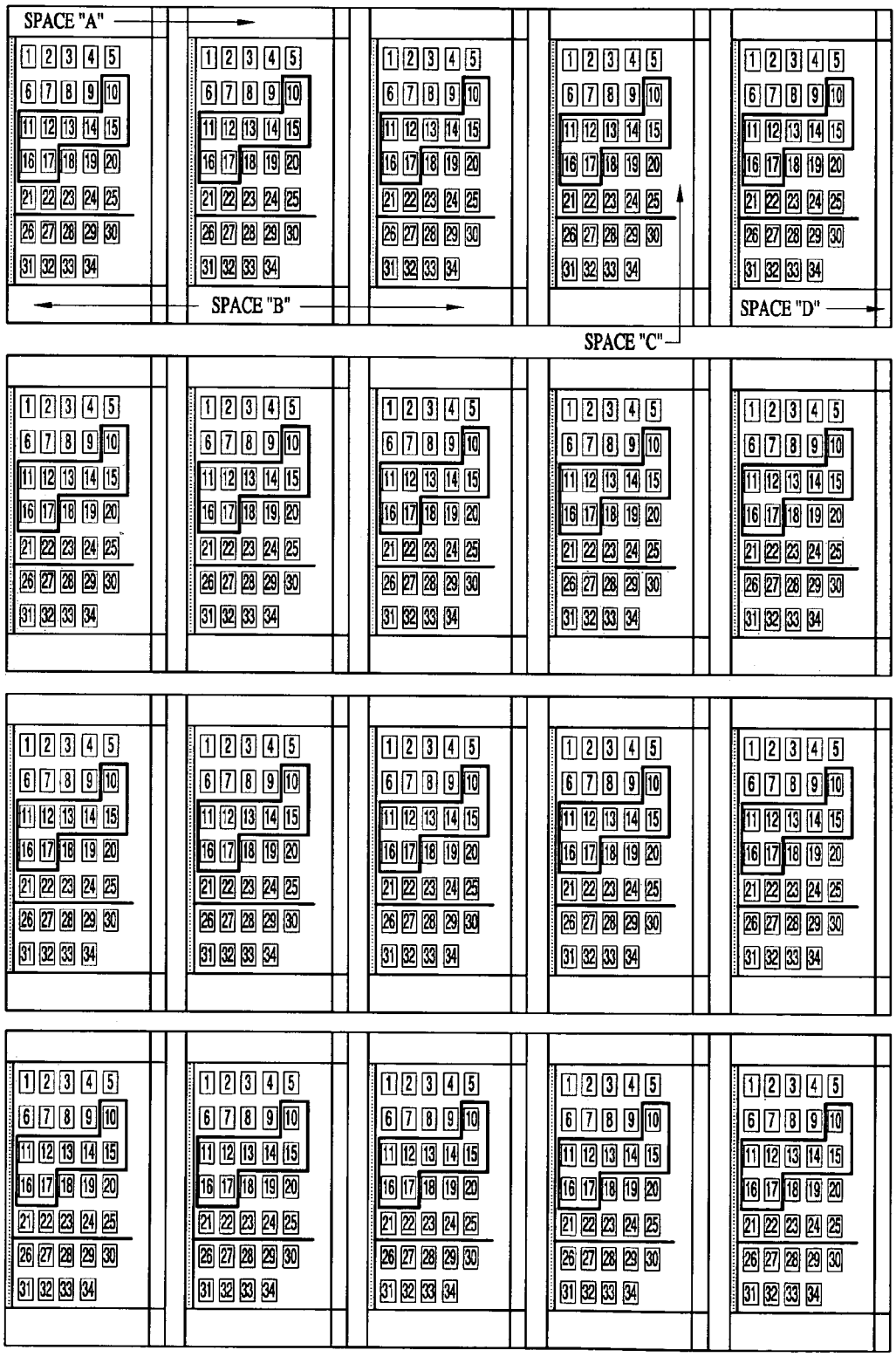
FIG. 7 depicts a further embodiment of a play slip having mulitiple boards.

FIG. 7 shows a play slip and play slip chart containing multiple boards. Each board has horizontal numbering positions divided into 4 zones with 3 landmark lines. As a play slip, at least one board is used for placing a bet. As a chart, the top or space "A" is used for game date and interval number of a module based on a specific number of previous games; space "B" is used for placing numbers as drawn; space "C" is used for placing notes by the player; and, space "D" is used for placing the number of correct numbers (digits) selected by the player.

Figure 8:
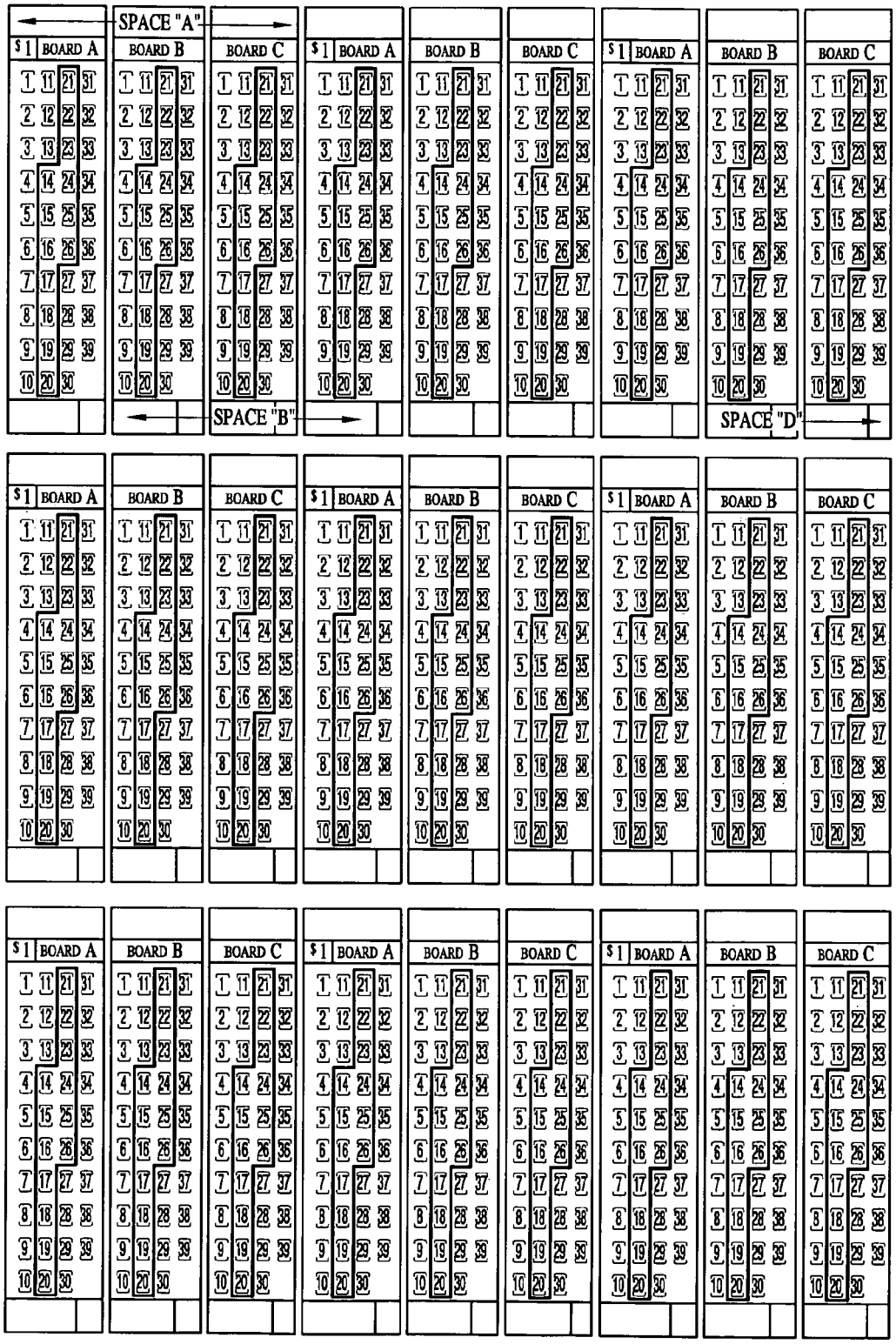
FIG. 8 shows a further embodiment of a play slip having multiple boards.

FIG. 8 shows a play slip and play slip chart containing multiple boards similar to an existing play slip with vertical numbering positions divided into 3 zones with 2 landmark lines.

As a play slip, at least one board is used for placing a bet. As a chart, the top or space "A" is used for game date and interval number of a module based on a specific number of previous games; space "B" is used for placing numbers as drawn; space "C" is used for placing notes by the player; and, space "D" is used for placing the number of correct numbers (digits) selected by the player.

Figure 9:
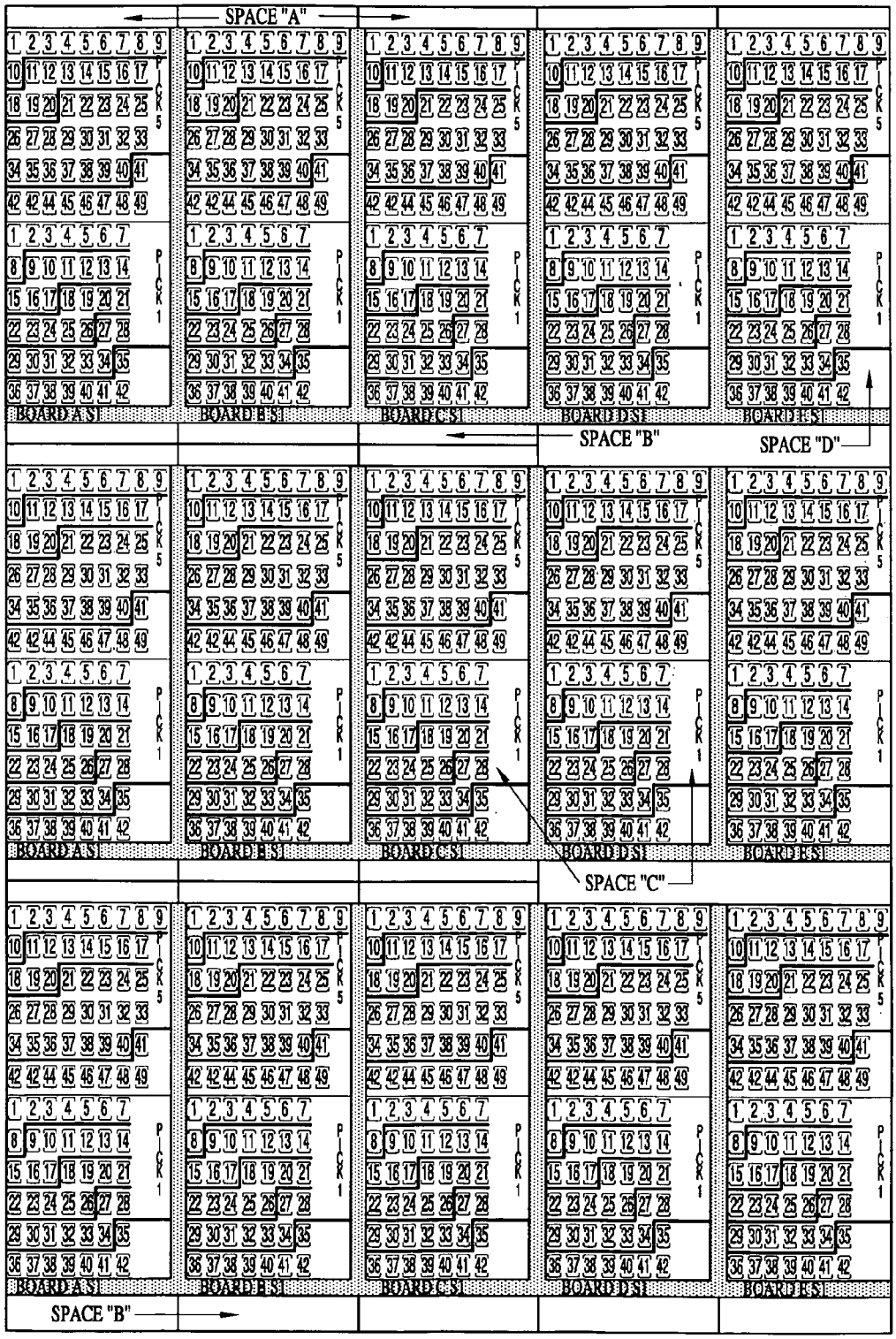
FIG. 9 depicts still a another embodiment of a play slip having multiple boards.

FIG. 9 shows a play slip and play slip chart containing multiple boards with an upper and lower portion. Both upper and lower portions have horizontal numbering positions divided into 5 zones with 4 landmark lines. As a play slip, at least one board is used for placing a bet. As a chart, the top or space "A" is used for game date and interval number of a module based on a specific number of previous games; space "B" is used for placing numbers as; space "C" is used for placing notes by the player; and, space "D" is used for placing the number of correct numbers (digits) selected by the player.

I claim:

1. A betting system comprising a play slip having at least one board including a plurality of numbers being arranged into a plurality of groups of numbers called positions, wherein said at least one board is divided into a plurality of zones by one or more landmark lines, wherein each board includes means for recording the game number, means for recording drawn numbers and means for recording the number of correct digits.

2. The betting system according to claim 1, wherein said positions include horizontal rows and/or vertical columns.

3. The betting system according to claim 1, wherein said landmark lines include any combination of horizontal and vertical lines.

4. The betting system according to claim 1, wherein said means for recording the game number indicates game date and/or game interval number.

5. The betting system according to claim 1, wherein said means for recording the drawn numbers indicates the numbers as drawn.

6. The betting system according to claim 1, wherein said means for recording the correct digit indicates the number of correct drawn numbers on the board.

7. The betting system according to claim 1, wherein said play slip includes indicia of correctness of the drawn numbers.

8. The betting system according to claim 1, wherein the plurality of zones includes three or more zones on each of said at least one board.

* * * * *